US008152494B2

(12) United States Patent
Parunak

(10) Patent No.: US 8,152,494 B2
(45) Date of Patent: Apr. 10, 2012

(54) METHODS AND SYSTEMS FOR FLUID CONTROL

(76) Inventor: Gene Parunak, Saline, MI (US)

( * ) Notice: Subject to any disclaimer, the term of this patent is extended or adjusted under 35 U.S.C. 154(b) by 639 days.

(21) Appl. No.: 12/369,727

(22) Filed: Feb. 11, 2009

(65) Prior Publication Data

US 2009/0202369 A1 Aug. 13, 2009

Related U.S. Application Data

(60) Provisional application No. 61/027,903, filed on Feb. 12, 2008.

(51) Int. Cl.
*F04B 17/00* (2006.01)
*F04B 35/04* (2006.01)

(52) U.S. Cl. ..... 417/420; 417/410.1

(58) Field of Classification Search ..... None
See application file for complete search history.

(56) References Cited

U.S. PATENT DOCUMENTS

2007/0292941 A1* 12/2007 Handique et al. ..... 435/288.7
2010/0173393 A1* 7/2010 Handique et al. ..... 435/287.2

* cited by examiner

*Primary Examiner* — Natalie Walford

(57) ABSTRACT

A magnetically coupled fluid actuator for microfluidic applications which affords the actuated fluid some degree of separation from the drive mechanism, increasing biocompatibility and making part of the device potentially disposable.

15 Claims, 2 Drawing Sheets

METHODS AND SYSTEMS FOR FLUID CONTROL

CROSS-REFERENCE TO RELATED APPLICATIONS

This application claims priority to provisional application No. 61/027,903 filed Feb. 12, 2008, which application is incorporated herein.

BACKGROUND OF THE INVENTION

The present invention is a fluid actuator which can be applied to microfluidic systems as well as to non-microfluidic fluid systems such as industrial fluid handling systems, automotive fluid handling systems, consumer product fluid handling systems, or any other fluid handling system where it is desirable to have part of the drive mechanism dissociated from contact with the fluid and/or the fluid path. These additional applications can be achieved by properly sizing the components, replacing the microfluidic substrate with an appropriate fluid path enclosure and by connecting the resulting pump to the chosen fluidic line through fittings appropriate and common for the desired application type.

The present invention is especially useful in applications where the part of the system in contact with the working fluid would benefit from being disposable.

Relevant documents include:

U.S. Pat. No. 6,951,632 issued in October, 2005 (Unger, et al.)

U.S. Pat. No. 6,415,821 issued in July, 2002 (Kamholz, et al.)

U.S. Pat. No. 6,048,734 issued in April, 2000 (Burns, et al.)

U.S. Pat. No. 4,152,099 issued in May, 1979 (Bingler)

U.S. Pat. No. 6,415,821 issued in July, 2002 (Kamholz, et al.)

U.S. Pat. No. 6,408,884 issued in December, 1999 (Kamholz, et al.)

Advantages of the Invention:

1. Does not require the working fluid to undergo significant temperature changes or significant changes in electrical potential which might affect the properties of the working fluid.

2. A large portion of the drive mechanism can be kept out of contact with the working fluid for better longevity of the drive mechanism and for minimal effects on the working fluid.

3. Does not require the fluid path or its housing to be in direct mechanical, electrical, or thermal contact with the drive mechanism 4. Allows the fluid path and its housing to be disposable if desired 5. Reduces the breakage potential associated with vaned or finned impellers 6. Can operate continuously or intermittently, in either direction, and at a variety of speeds 7. Does not incorporate a diaphragm or other flexible membrane (which are subject to eventual failure)

8. Requires minimal dead volume within the pump circuit

9. Geometrically flexible—can be implemented in many different contexts.

10. Does not require air to be present in the fluid path (as do some pumps) thus reducing the potential for adding bubbles to the working fluid 11. Does not require the use of a ferrofluid or magnetic liquid which may be bio-incompatible due to the surfactants typically used in their compositions, and which necessarily blocks a portion of the fluid path when at rest.

BRIEF SUMMARY OF THE INVENTION

The present invention is a device (pump) for creating and controlling fluid flow within microfluidic systems. The pump consists of one or more magnetic pellets contained in a circuit (or raceway) within a microfluidic substrate. The circuit has an inlet and an outlet, and when the system is filled with a liquid, the motion of a magnet (or magnets) external to the microfluidic substrate induces a motion of the magnetic pellet(s) in such a way as to drive them around the circuit. The motion of the pellet(s), in turn, creates a flow of fluid from the inlet to the outlet which can be continued indefinitely, started, stopped, slowed down, sped up and driven equally well in reverse. This control is achieved by varying the direction and speed of the external magnets. Chemical/biological compatibility with the working fluid as well as pellet longevity is achieved by way of pellet material selection and/or pellet coating selection.

BRIEF DESCRIPTION OF THE SEVERAL VIEWS OF THE DRAWING

Note: With the exception of FIG. 6, all drawings illustrate the fluidic channels, but not the substrate of the device. Any method by which the fluidic channels may be formed and sealed is acceptable, with the method illustrated in FIG. 6 being the preferred embodiment.

DETAILED DESCRIPTION OF THE INVENTION

Figure 1:
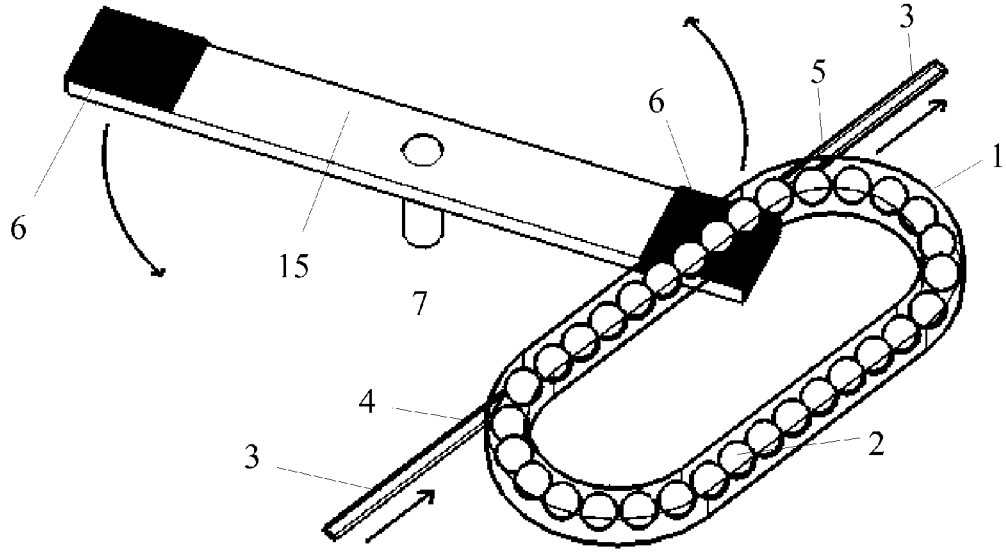
FIG. 1—A perspective view from above of the pump in accordance with a first embodiment of the invention FIG. 2—A right-side view of the pump of FIG. 1
Figure 2:
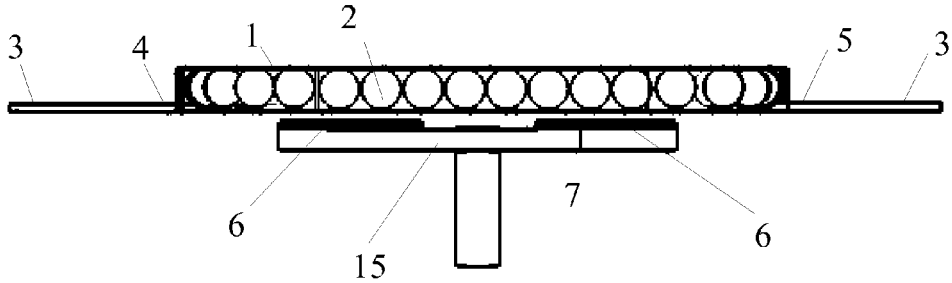
Figure 3:
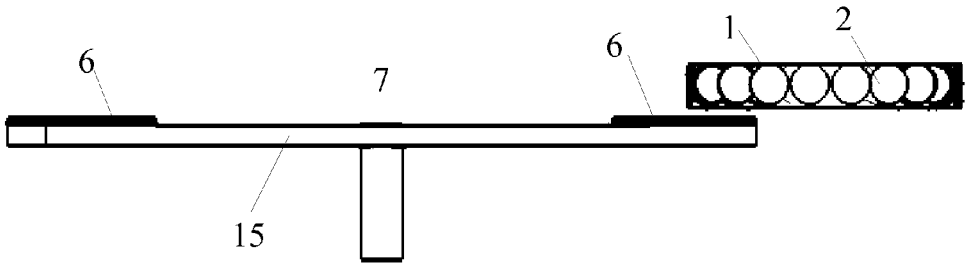
FIG. 3—A front view of the pump of FIG. 1
Figure 4:
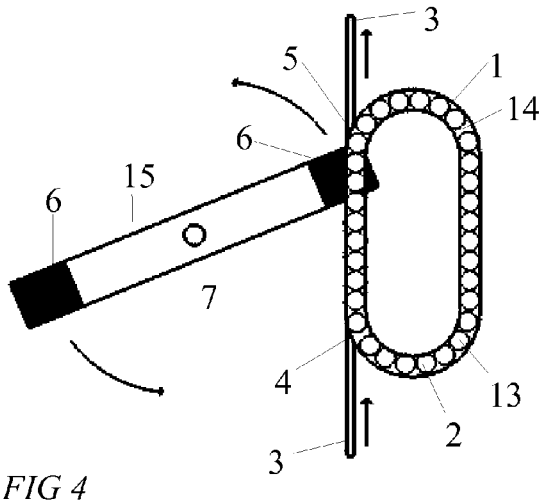
FIG. 4—A top view of the pump of FIG. 1
Figure 5:
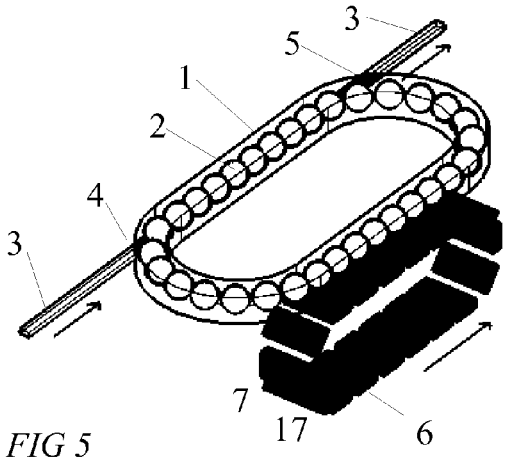
FIG. 5—A perspective view from above of the pump of FIG. 1 (belt drive variation)

FIGS. 1, 2, 3, 4, 5, 8, and 9 reference a first embodiment of a fluidic pump that includes a pump circuit 1 having an inlet 4 and an outlet 5, the pump circuit 1 containing a plurality of magnetically responsive pellets 2. These pellets 2 may be made from any appropriate magnetically responsive material, such as nickel, iron, or cobalt and may be coated with a relatively inert material 13 such as polytetrafluoroethylene (PTFE) or left bare if acceptable from a wear standpoint and/or from a biochemical compatibility standpoint with the working fluid 14.

Figure 6:
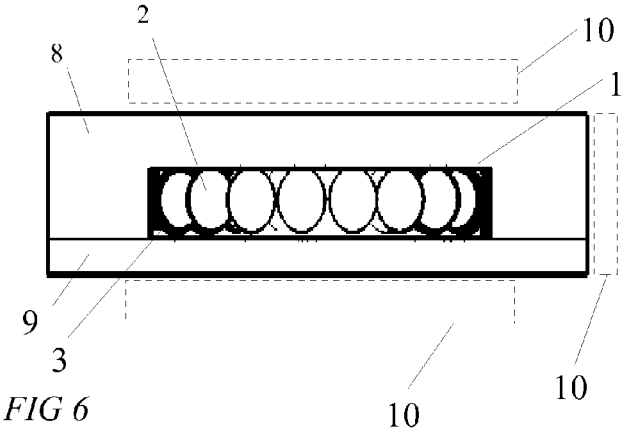
FIG. 6—A front view of the pump of FIG. 1

In the preferred form, the features and components of the fluidic pump are contained in a traditional multi-layer microfluidic substrate consisting of a channel substrate 8 and a seal substrate 9 which are typically made from glass or from a polymer such as cyclicolefinpolymer (COP), cyclicolefincopolymer (COC), polycarbonate, polypropylene, polyethylene, or polydimethysiloxane (PDMS) which may be substantially optically clear or opaque depending on the desired application for the rest of the substrate. The layers 8,9 are typically joined by gluing, ultrasonic welding, laser welding, plasma bonding, and/or other thermal and/or adhesive methods. Although the geometry in FIG. 6 is typical, there is nothing preventing the pump from being formed within a volume consisting of less than or more than two substrates. Additionally, it is not critical that the seal substrate 9 be completely flat, but may itself include fluid path geometry. Fluid path geometry need not be planar, but may be 3 dimensional through the body of a given substrate as desired. In a component application (not necessarily microfluidic) we anticipate that the geometry may be formed not in generally flat substrates, but in formed components with geometry specifically suited to their use (i.e. A traditional pump housing for automotive or other applications does not normally appear as a flat plate.)

Although generally displayed as an oval or a circle in this disclosure, the pump circuit 1 need not be constrained to that geometry for this embodiment. The pump circuit 1 may be of any shape and need not be limited to a planar form (its path may extend into three dimensions) so long as the circuit 1 is always completed, and there exists an inlet 4 and an outlet 5 to the circuit 1 positioned such that flow of pellets 2 and working fluid 14 around the circuit 1 of the pump will induce a flow between the inlet 4 and the outlet 5. Additionally, the plane of the circuit 1 need not be parallel to the plane of the substrates 8,9.

In this embodiment, the magnetically responsive pellets 2 are larger than the cross section of the inlet 4 and outlet 5, otherwise there may be a filter, screen, or mesh (not shown) at the inlet 4 and the outlet 5 which prevents any non-responsive pellets 2 from exiting the circuit 1. Although not critical to the success of the device, for completeness, we note that the cross sectional dimensions of the various features (channels, pellets, inlet, outlet) may be on the order of 10 to 1000 microns.

Proximal to a portion of the circuit 1 is a magnetic array 7 consisting of one or more magnets 6 actuated by a rotor 15, or a belt, chain, or rail drive 17. When the primary fluid path 3 and the pump circuit 1 are filled with a working fluid 14, the motion of the magnetic array 7 past a given section of the circuit 1 (one of the magnetic actuation zones 10) induces a motion of the magnetically responsive pellets 2. The motion of the pellets 2 in turn induces a fluid flow from the inlet 4 of the pump to the outlet 5, thus inducing flow within the primary fluid path 3. This flow may be started, stopped, sped up, slowed down, and reversed by appropriately controlling the speed and direction of the array 7.

The magnetic array may be placed at any convenient location and at any convenient orientation to the pump circuit 1 as shown in FIG. 6 so long as the magnets 6 travel near a portion of the circuit 1 in a direction suitable for motivating the pellets 2 in the desired direction. In this embodiment the magnetically responsive pellets must fill the majority of the circuit, such that driven pellets can push non-driven pellets into a position to be driven by the next magnet in the array. This is not a requirement in the next embodiment wherein the actuation zone and the circuit are fully overlapping.

Figure 7:
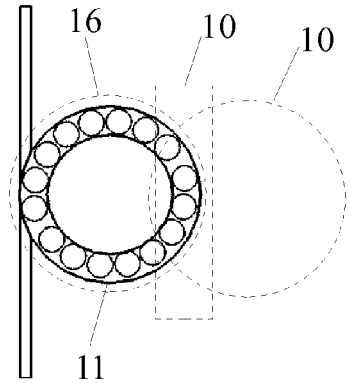
FIG. 7—A top view of the pump in accordance with both the first, second, and third embodiments of the invention FIG. 8—A right-side view of the pump of FIG. 5
Figure 8:
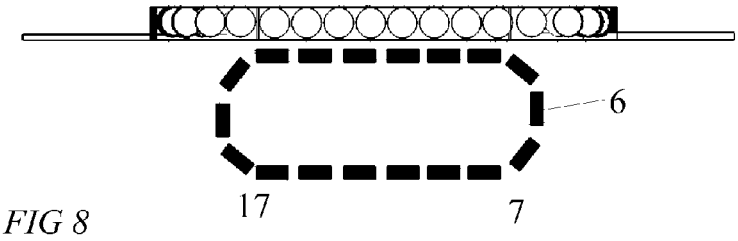
Figure 9:
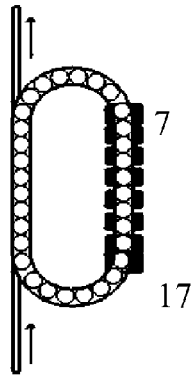
FIG. 9—Atop view of the pump of FIG. 5

A second embodiment, otherwise identical to the first embodiment is shown in FIG. 7. In this embodiment, the magnetic actuation zone 16 and the circuit 11 are fully overlapping. This is in distinction to the magnetic actuation zones 10 shown in FIG. 7 (for the first embodiment) which do not fully overlap the circuit 11. The circuit 11 must be generally circular such that the effect of the magnetic array 7 can reach the entirety of the circuit 11 given sufficient magnets.

Any number and size of pellets 2 and any number of magnets 6 may be used, so long as the number of magnets 6 is sufficient to constantly control the pellets 2 should their cross-sectional area be smaller than the cross-sectional area of the inlet 4 and outlet 5, thus preventing the pellets from exiting the circuit 11.

A third embodiment, otherwise identical to the first embodiment eliminates the use of traditional magnets, replacing them with stationary electromagnets. Also, some of the magnetically responsive pellets 2 must be replaced with similar, but non-magnetically responsive pellets. In this way, through an on-off actuation sequence of one or more electromagnets, the responsive pellets 2 may be driven around the circuit 1, carrying the un-responsive pellets with them. If all pellets were responsive, a pulsing action of one or more electromagnets would not drive them around the circuit 1.

Additionally, it is anticipated that any magnet referred to in the first and second embodiments could be eventually replaced with a non-stationary electromagnet, while keeping to the intent of the first and second embodiments.

What is claimed is:

1. An fluid handling device comprising: a substrate defining a circuit or recess in fluid communication with a primary fluid path; at least one solid pellet disposed within the recess; and at least one magnet proximal to at least a portion of the recess wherein, when the magnet is actuated, the pellet moves.

2. The fluid handling device of claim 1 wherein a motion of the pellet induces fluid flow within the primary fluid path.

3. The fluid handling device of claim 1 wherein the pellet travels in a circular pattern.

4. The fluid handling device of claim 1 wherein the pellet travels in a non-circular pattern.

5. The fluid handling device of claim 1 wherein the magnet is an electromagnet.

6. The fluid handling device of claim 1 wherein the smallest diameter of the cross section of the primary fluid path is less than the smallest diameter of the pellet.

7. The fluid handling device of claim 1 wherein the circuit is substantially filled with a combination of magnetically responsive pellets and non-magnetically-responsive pellets.

8. The fluid handling device of claim 6 wherein at least one additional non-magnetic pellet is disposed within the circuit or recess, wherein, when the first pellet is actuated, the additional pellet moves.

9. A method for producing a fluid handling device, comprising: providing a substrate defining a circuit or recess in fluid communication with a primary fluid path; introducing at least one solid pellet into the circuit or recess; and placing the substrate in proximity to at least one magnet, wherein, when the magnet is actuated, the pellet moves.

10. The method of claim 9 wherein the magnet is actuated by a spindle.

11. The method of claim 9 wherein the magnet is actuated by a belt or chain drive.

12. The method of claim 9 wherein the magnet is an electromagnet.

13. The method of claim 9 wherein the diameter of the smallest cross-section of the pellet is less than the diameter of the smallest cross-section of the recess.

14. The method of claim 9 wherein the circuit as well as the magnet path are circular and substantially overlapping.

15. A method for moving fluid in a fluid handling device, comprising the steps of: providing a substrate defining a circuit or recess in fluid communication with a primary fluid path; introducing at least one solid pellet into the circuit or recess; and placing the substrate in proximity to at least one magnet and actuating the magnet, wherein, when the magnet is actuated the pellet moves and induces flow in the primary fluid path.

* * * * *